United States Patent [19]

Gutmann

[11] Patent Number: 4,617,560

[45] Date of Patent: Oct. 14, 1986

[54] SMOKE OR FIRE DETECTOR

[76] Inventor: Robin P. E. Gutmann, 3051 Grant St., Hollywood, Fla. 33020

[21] Appl. No.: 688,007

[22] Filed: Dec. 31, 1984

[51] Int. Cl.[4] ..... G08B 17/10

[52] U.S. Cl. ..... 340/628; 340/629; 340/630

[58] Field of Search ..... 340/628, 629, 632, 633, 340/630; 350/381, 382, 384, 385, 573, 574

[56] References Cited

U.S. PATENT DOCUMENTS

| | | | |
|---|---|---|---|
| 3,209,343 | 9/1965 | Dunham et al. | 340/632 X |
| 3,948,202 | 4/1976 | Voshikawa | 340/632 X |
| 4,097,851 | 6/1978 | Klein | 340/629 X |
| 4,238,677 | 12/1980 | Hugon | 340/629 |

*Primary Examiner*—James L. Rowland

*Assistant Examiner*—Daniel Myer

*Attorney, Agent, or Firm*—Eugene F. Malin

[57] ABSTRACT

This invention is a smoke or fire detector that first utilizes a signal that is indicative of a detected smoke or fire condition to operate an air moving device to purge the detectors photocell or ionization chamber and to thereafter allow an additional signal indicative of a detected smoke or fire condition within a predetermined time frame to provide an alarm signal. The smoke or fire detector avoids many false alarm situations by placing a cyclic purge switching control system between the smoke or fire detector and the alarm signal device. The cyclic purge switching control system sequentially connects the signal indicative of a detected smoke or fire condition between the air moving device such as a fan and the alarm signal device.

7 Claims, 5 Drawing Figures

SMOKE OR FIRE DETECTOR

BACKGROUND OF THE INVENTION

The present invention relates to a smoke or fire detector that first utilizes the initial signal that is indicative of a detected smoke or fire condition to operate an air moving fan to purge the detector's photocell or ionization chamber insted of sounding an alarm. Thereafter, any additional signal indicative of a detected smoke or fire condition within a predetermined time frame is utilized to signal an alarm. The detector's photocell or ionization chamber detects smoke or a fire condition after an initial purge cycle.

In the past elaborate systems have been devised to prevent false alarms from fire and smoke detectors and yet to continue to detect fire and smoke. Sensitivity compensated fire detectors such as disclosed in Ray W. Klein's U.S. Pat. No. 4,097,851 have been disclosed. Other alarm devices have provided reference and measurement chambers as disclosed in the Emele L. Hugon U.S. Pat. No. 4,238,677. Other systems have been proposed and tried.

Prior fire and smoke detectors have employed a sensing device, such as a photocell or more commonly an ionization chamber, for detecting products of combustion. In an ionization chamber, a source of radiation ionizes air molecules between a pair of spaced electrodes, across which a voltage is applied to establish an electric field. The electric field moves the ionized molecules between the electrodes to provide a current flow. The space between the electrodes is open to the atmosphere, and upon the occurrence of fire products of combustion enter the chamber and combine with ionized air molecules to reduce the current flow and thereby increase the impedance of the chamber. This change in impendance occurs relatively rapidly and generates an electric signal indicative of a detected smoke or condition which, through detecting circuitry, causes an alarm to be sounded.

A disadvantage of such detectors is that certain naturally occurring atmospheric conditions, such as changes in atmospheric pressure and relative humidity, accumulation of films of dirt and dust, etc., affect the magnitude of the current flow in the detecting chamber and may change the sensitivity of the detector, rendering the detector in many cases susceptible to generating spurious alarms.

One way that has been disclosed to minimize the occurrence of spurious alarms is to decrease the sensitivity of the detector to account for all reasonably anticipated variations in ambient conditions. Unfortunately, this technique also reduces sensitivity to products of combustion.

Other prior art devices include detectors having a sensor device for detecting a predetermined phenomenon, and in particular to a detector which is compensated against changes in sensitivity resulting from natural and slowly occurring ambient variations which affect the sensor.

Others have provided devices that deal with smoke and fire detectors of the type in which detection is performed by measuring ionization of the ambient environment, and deals more particularly with a detector provided with an electronic velocimetric circuit which screens out spurious, false alarm signals produced by pollutants within the ambient environment, inadvertant short term connecting or disconnecting of the detector, electrical interference signals, faulty insulation of electrical components, variations in supply voltage, and the like.

SUMMARY OF THE INVENTION

The present invention is a new and useful smoke or fire detector that utilizes the movement of air to initially purge the smoke or fire detector after a first initial signal that is indicative of the presence of smoke or fire in order to require a second signal from the smoke or fire detector to be transported to an alarm in order to sound the alarm. The two step detection system prevents many false alarms caused by transient smoke or fire, transient pollutive contaminants suspended in the ambient environment or other transient natural occurring conditions. Any well known smoke or fire detection chamber and smoke or fire detector circuit may be used. An audible signal means or other type of signal means to a near or remote location may be utilized. The smoke or fire detector circuit and alarm or signal means location may be powered by batteries or by ordinary current.

The improvement may be used in any discriminative smoke or fire detector that includes a smoke or fire detector sensing system for producing a signal indicative of a detected smoke or fire condition in the smoke or fire detector sensing circuit and an alarm. The alarm that is connected by conductive lines to the smoke detector sensing circuit for transmitting the signal indicative of a detected smoke or fire condition from the smoke detector sensing circuit is modified or interrupted by a discriminator smoke purge switching control circuit having two modes. An air moving means such as a fan is connected to the sensing chamber that houses the smoke or fire detector sensing circuit to remove smoke or fire materials from the sensing chamber. The fan control circuit is connected to the discriminator smoke purge switching control circuit to purge the detector. The cyclic discriminator smoke purge switching control circuit drives the fan in the sensing chamber through the fan control circuit. The discriminator smoke purge switching control circuit is also connected between the smoke or fire detector sensing circuit and the alarm. The discriminator smoke purge switching control circuit activates the sensing chamber clearing fan to purge the detector chamber in the first mode. Detector circuits as disclosed in U.S. Pat. Nos. 4,097,851 and 4,238,677 are incorporated herein by reference and relied upon as part of this disclosure.

It is an object of this invention to provide a non-complex system to stop transient conditions that render a smoke or fire detector susceptible to generating spurious alarms.

It is another object of this invention to provide a low cost means of controlling false alarms in a smoke or fire detector and yet to provide an uninhibited smoke or fire detection.

In accordance with these and other objects which will be apparent hereinafter, the instant invention will now be described with particular reference to the accompanying drawings.

DETAILED DESCRIPTION OF THE PREFERRED EMBODIMENT

Figure 1:
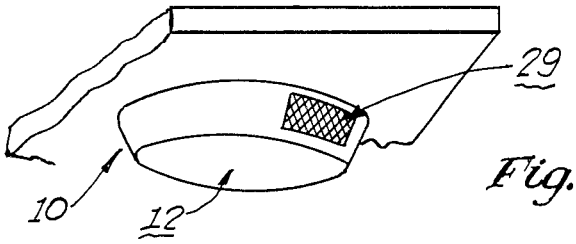
FIG. 1 is an illustration of a household smoke or fire detector.
Figure 2:
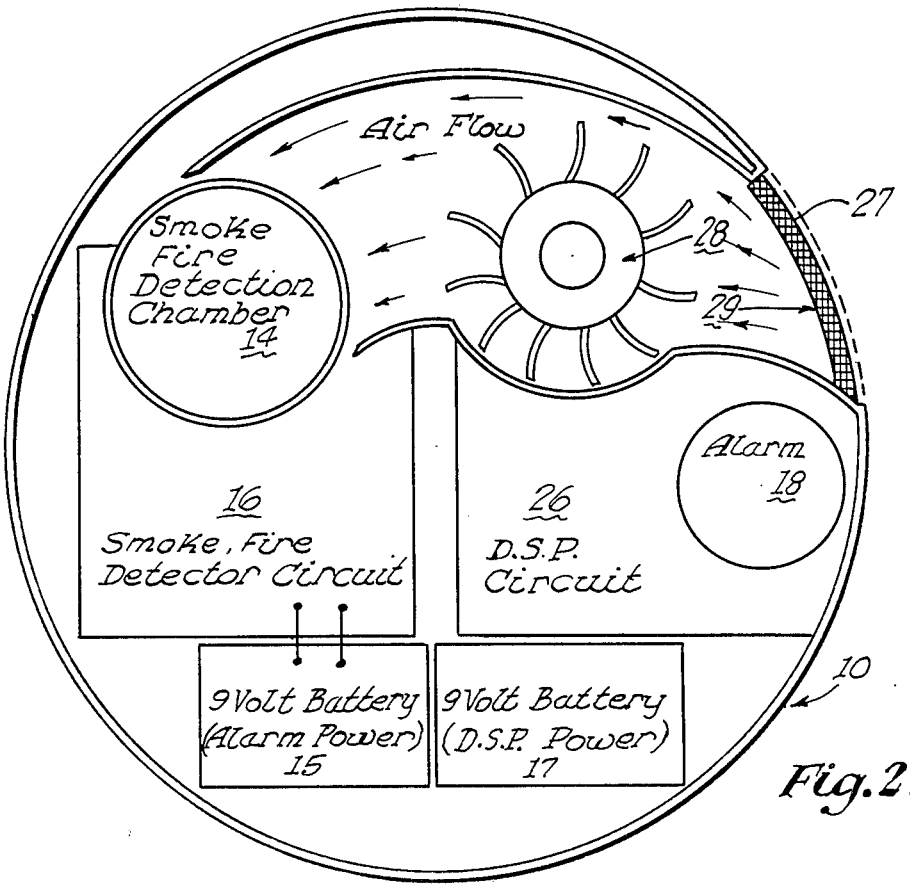
FIG. 2 is a block illustration of the physical layout of the smoke or fire detector.
Figure 3:
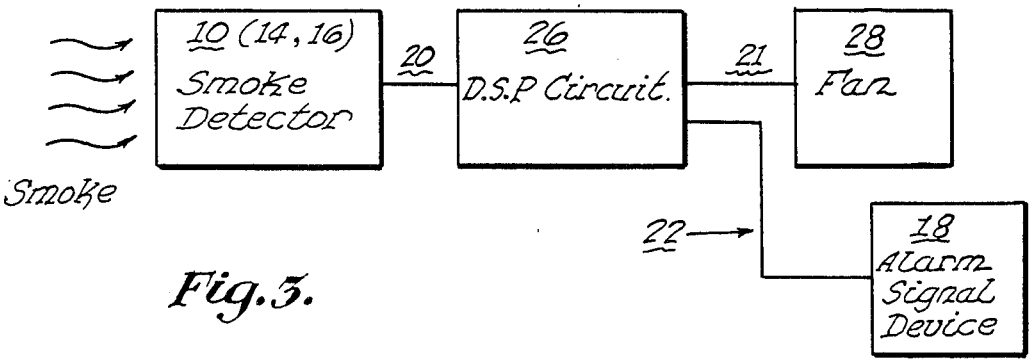
FIG. 3 is a block diagram of the electrical discriminator smoke purge switching control circuit of the invention.

Referring now to FIGS. 1, 2 and 3 the smoke or fire detector 10 is illustrated in FIG. 1 with a cover 12 having a photo or ionization sensing chamber 14 shown in FIG. 2 and connected smoke detector sensing circuit 16 of any well known type such as those well known in the art and shown in U.S. Pat. Nos. 4,097,851 and 4,238,677.

The new and improved smoke or fire detector system utilizes the movement of air in the direction of arrows A and B to purge the smoke or fire sensing chamber 14 after a first signal indicating the presence of smoke or fire in the sensing chamber 14. Thereafter if a second signal after a preset time period or a continuous second signal indicating the presence of smoke or fire is detected by the smoke or fire detector then the alarm 18 will sound. If the initial signal indicating smoke or fire continues from the detector after smoke purge cycle, it will be regarded as a second signal and will activate the "B MODE" audible alarm. The two step detection system prevents many false alarms caused by transient smoke, pollutive contaminants suspended in the ambient environment or other transient natural occurring conditions that may occur in the sensing chamber.

Any well known smoke or fire detection chamber 14 and smoke or fire detector circuit 16 may be used, such as those described in the Klein patent or the Hugen patent. The present invention inserts a discriminator smoke purge switching control circuit 26 with timing means and switch relays between the smoke or fire detector sensing circuit 16 and the alarm 18. The discriminator smoke purge switching control circuit 26 as shown in FIG. 3 controls the new and improved sensing chamber clearing fan control circuit shown in FIG. 5 and the alarm signal device 18 shown in FIG. 3. Alarm devices such as those shown in the Klein patent or Hugen patent may be utilized. The fan control circuit shown in FIG. 5 controls the fan 28 shown in FIGS. 2 and 3. The fan 28 shown in FIG. 2 includes an inlet 29 that may or may not include a micro filter 27 that aids in filtering the air used to purge the sensing chamber 14.

The discriminator smoke purge switching control circuit 26 operates in two modes. The first mode (1) operates the fan control circuit shown in FIG. 5 to operate the fan 28. The second mode (2) operates the alarm signal device 18 through line 22.

Figure 4:
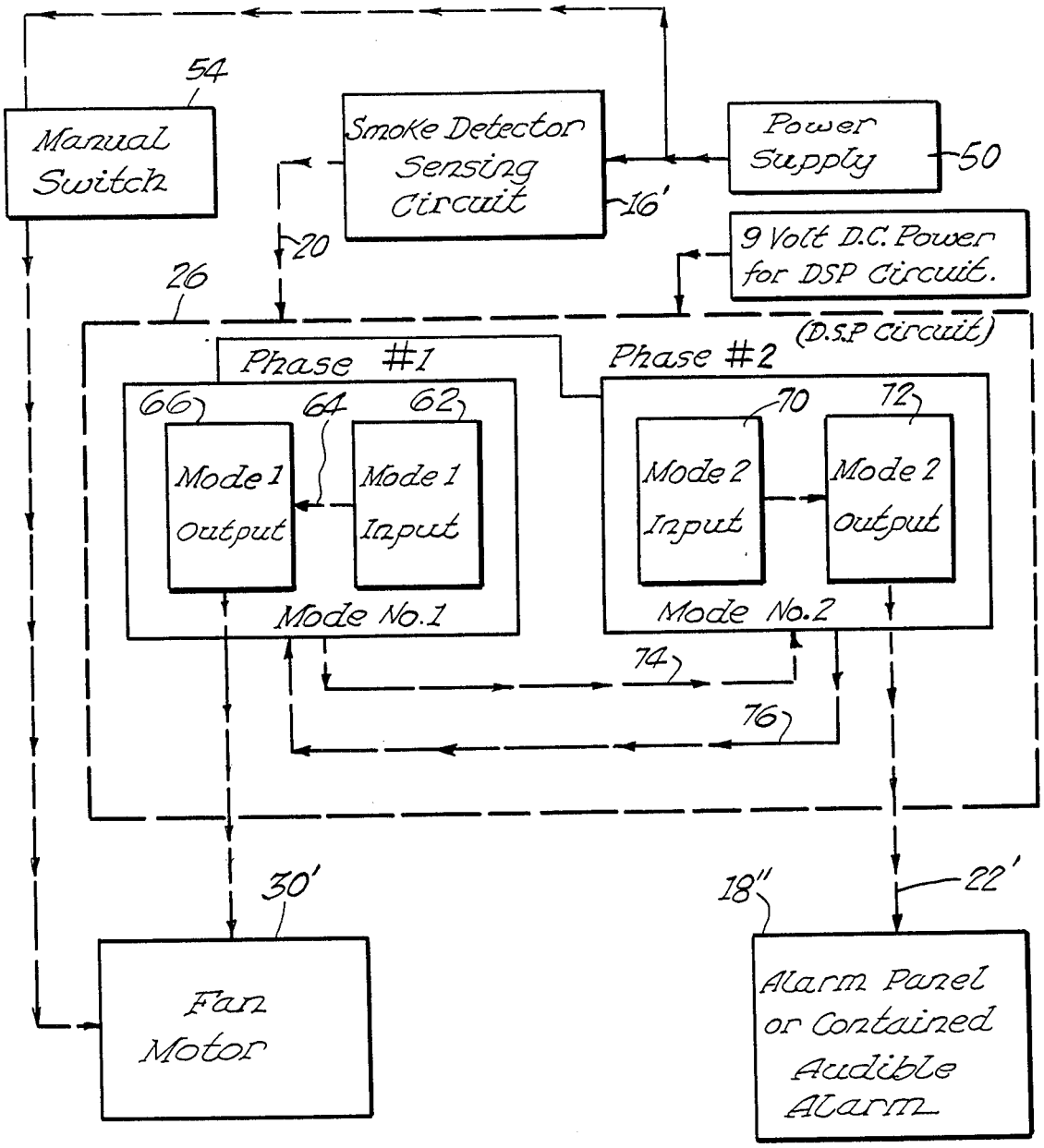
FIG. 4 is a timing diagram for the switch control circuit in the system.

Referring now to FIG. 4, the power supply 50 having batteries or a transformer from 115 volt supply provides power to the smoke detector sensing circuit 16' of the smoke detector 10 such as any well known detector. The Klein U.S. Pat. No. 4,097,851 or the Hugon U.S. Pat. No. 4,238,677 are incorporated herein by reference as an example of known smoke detectors that may be utilized. The power supply 50 provides power to a manual switch 54 for testing the device and for turning on the fan for testing its operability or to clear smoke from the detector for test purposes. The manual switch 54 is connected directly to the fan circuit 30 or to another air supply type device.

The smoke detector sensing circuit 16 has a signal output at 20 to the discrimination smoke purge circuit switching control 26 in FIG. 3, also known as the D.S.P. input. The timing of the circuit is as follows:

During Mode 1, the input to 62 shown in FIG. 4 from an initial smoke or fire signal output from the smoke sensing detector circuit 16 provides an activation signal on line 64 to mode 1 output 66. There is no limit on time for mode 1 to receive an initial alarm signal. Mode 1 output 66 provides a current supply to the fan circuit 30, a sensing chamber clearing control circuit for a clearing control circuit cycle. The discriminator smoke purge switching control circuit 26 provides timed current controls for 10 seconds to drive the fan 28 from the fan circuit 30. The fan or other air supply device purges smoke out of the sensing chamber 14 for 10 seconds as illustrated in FIG. 2.

The mode 1 is switched by line 74 or to activate mode 2 after 10 seconds cycle of the sensing chamber cycle. Mode 2 is switched through line 76 to 1 after three minutes of operation under mode 2 operating cycle.

A second output signal indicative of smoke or fire or a continuous signal over ten seconds in duration from the sensing circuit 16 within mode 2 three minute time frame from completion of a mode 1 operation, will operate the alarm. Any second signal output from the smoke detector sensing circuit 16 is now directed through the mode 2 input 70 to mode 2 output 72 to the audible alarm 18 and/or an alarm panel contact the alarm sounds for an indefinite time period, until manually reset back to mode 1. If their is no sound output signal the device is reset after 3½ minutes back to mode 1.

Figure 5:
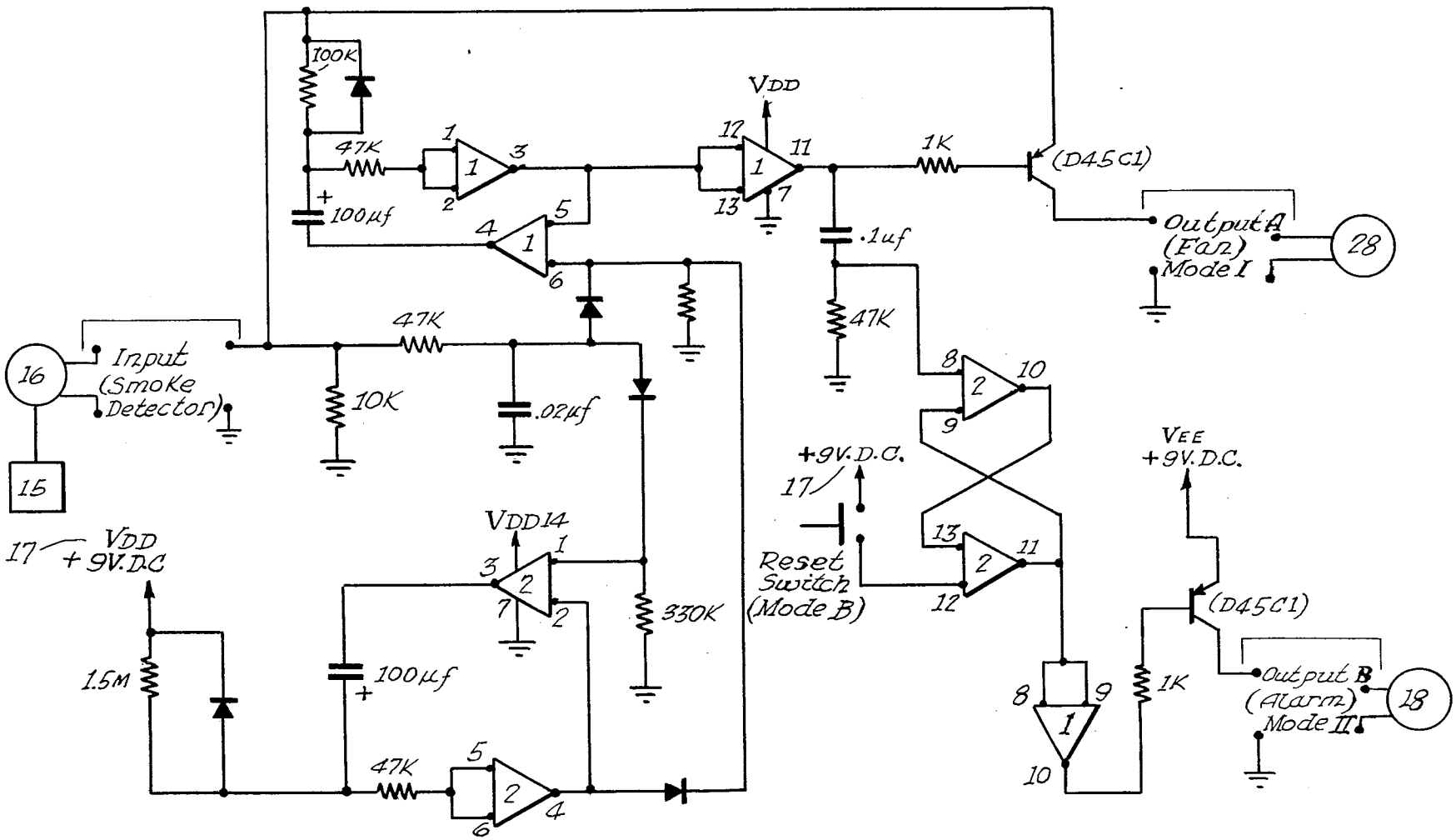
FIG. 5 is a schematic of the discriminator smoke or fire purge switching control circuit.

In use the discriminative smoke or fire purge detector 10 includes a smoke or fire detector sensing system for producing a signal indicative of a detected smoke or fire condition. The alarm is not connected directly to the smoke detector sensing circuit. A purge switching control circuit 26 is used to transmit a signal indicative of a detected smoke or fire condition from the sensing chamber 14 to the alarm 18 to sound an alarm. The signal is interrupted by a cyclic switching system that first starts an air moving fan 28 for ten to fifteen seconds, but preferrably ten seconds, to purge the sensing chamber of the smoke or fire detector. One switching control circuit 26 is illustrated in FIG. 5. The battery is connected to surrent 16 that is connected to terminals 50 and 52 to provide circuit 26 with a signal input. Battery 17 may also be connected as shown. The switching circuit provides the ten second and three minute timing cycles.

A first signal from the sensing chamber may also be initially connected to the fan. A timer may hold the switch or solenoid switch in the fan position for ten seconds. Then the solenoid switch may be automatically operated to place an additional signal in direct contact with the alarm. A second timer holds the solenoid switch in the second position for three minutes. Thereafter the solenoid switch is de-energized to start the cycle over again to direct any additional signals to the fan and to initiate the ten second timer.

The signal from the sensing chamber is sequencially connected between the fan position and then to the alarm position. The fan will operate for a time determined by the first timer. Therefore the discriminative smoke or fire detector includes a smoke or fire sensing chamber for producing a signal indicative of a detected smoke or fire to first purge the sensing chamber by air and then to retest the air to give a true alarm if necessary. The improvement includes an air moving fan and an air moving fan control circuit connected to said air moving fan. The discriminating smoke purge circuit may include the circuit shown in FIG. 5 or any similar circuit well known in the art or may include at least one solenoid switch with an air moving control position connected to the fan control circuit and an alarm position connected to the alarm. The discriminating smoke purge circuit detects the first signal and starts the fan and times the fan operation for ten seconds and thereafter switches the solenoid switch from the fan connection to the alarm connection. If voltage input continues after fan cycle the alarm will sound or send an alarm output signal for an indefinite period unless manually reset. If input voltage ceases prior to the ten second cycle due to the elimination of a spurious condition the discrimination smoke purge circuit will switch to the three minute "B Mode" when if activated by a second or additional alarm input will activate an audible alarm or alarm output signal to a panel for an indefinite period of time until reset manually by "B Mode" reset switch. This, however, does not affect the 3½ minute cycle time. Thereafter the start position is restored after termination of the predetermined three minute time period. Any additional signals received during the three minute period are directed to the alarm.

Therefore by adding a fan, a solenoid switch and two timers in a discriminating smoke purge circuit, an ordinary smoke or fire detector may be made more accurate by eliminating transient false alarms. This is accomplished without hampering detection of smoke or fire by the sensing chamber.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A discriminative smoke or fire detector for preventing false alarms caused by transient smoke or fire in the ambient environment, said detector including a smoke or fire detector sensing system with a sensing means in a sensing chamber for producing a first signal indicative of a detected transient smoke or fire condition and an alarm signal means operably connected to said detector sensing system for providing an alarm signal, comprising:

an air moving means for conveying air through said chamber for purging transient smoke or fire in the ambient environment from said chamber;

an air moving control means connected to said air moving means for controlling operation of said air moving means;

switching control means for cyclically effecting operation of said air moving means and operation of said alarm signal means, said switching control means including a first means responsive to the presence of smoke or fire for providing a first signal for generating electric current to said air moving control means, and a second means for activating said air moving means for conveying air through said chamber for purging said chamber of said transient smoke or fire thereby requiring a second signal for generating an electric current for activating said alarm signal means, said switching control means responsive to the presence of additional smoke or fire in said purged chamber for generating an electric current for providing a second signal for activating said alarm signal means.

2. A detector as set forth in claim 1, wherein:

said switching control means includes timer means for controlling the cycle of operation to provide an operational time that said air moving means is operational and an operational time for operating said alarm signal means through said second means.

3. A detector as set forth in claim 2, wherein:

said air moving means is a fan.

4. A detector as set forth in claim 3, wherein:

said switching control means and said timer means providing approximately 10 second operational time for said fan, said switching control means and a timer means providing approximately 3 minutes operational time for said second signal to activate an audible alarm output signal for an indefinite time period.

5. A detector as set forth in claim 4 wherein:

said switching control means and said timer means latches for an indefinite period of time if said alarm is activated until manually reset.

6. A detector as recited in claim 1, wherein said switching control means is connected between said detector sensing system and said signal means.

7. A detector as recited in claim 6 wherein said switching control means includes timing means for cyclicly connecting the signal from said sensing means to said first means and then to said second means and then back to said first means to protect against transient conditions that could generate spurious alarms.

* * * * *

UNITED STATES PATENT AND TRADEMARK OFFICE

CERTIFICATE OF CORRECTION

PATENT NO. : 4,617,560

DATED : October 14, 1986

INVENTOR(S) : Robin P.E. Gutmann

It is certified that error appears in the above-identified patent and that said Letters Patent is hereby corrected as shown below:

Colume 4, line 47, "surrent 16" should be --circuit 16--.

Signed and Sealed this

Twenty-fourth Day of March, 1987

*Attest:*

DONALD J. QUIGG

*Attesting Officer*

*Commissioner of Patents and Trademarks*